US005314151A

United States Patent [19]

Carter-Mann

[11] Patent Number: 5,314,151

[45] Date of Patent: May 24, 1994

[54] PLASTIC BAG HANGER DEVICE

[76] Inventor: Candice Carter-Mann, 10628 E. Turquoise Ave., Scottsdale, Ariz. 85258

[21] Appl. No.: 989,354

[22] Filed: Dec. 11, 1992

[51] Int. Cl.[5] ..... B65B 67/04

[52] U.S. Cl. ..... 248/100; 248/101; 248/231.8

[58] Field of Search ..... 248/95, 99, 97, 100, 248/101, 231-238; 220/404

[56] References Cited

U.S. PATENT DOCUMENTS

| | | | |
|---|---|---|---|
| 4,735,340 | 4/1988 | Preston et al. | 220/404 |
| 4,762,297 | 8/1988 | Milligan | 248/100 |
| 4,763,808 | 8/1988 | Guhl et al. | 220/404 |
| 4,856,675 | 8/1989 | Palazzola | 220/404 |
| 4,923,087 | 5/1990 | Burrows | 220/404 |
| 4,925,056 | 5/1990 | McCoig | 220/404 |
| 4,934,637 | 6/1990 | Guerrera | 248/100 |
| 4,946,065 | 8/1990 | Goulter et al. | 202/404 |
| 4,997,149 | 3/1991 | Koch | 248/100 |

*Primary Examiner*—Ramon O. Ramirez

*Attorney, Agent, or Firm*—David G. Rosenbaum; Laura J. Zeman

[57] ABSTRACT

A new and improved plastic bag hanger device is presented for employing plastic bags, especially those plastic bags with handles which are used for bagging groceries, as liners for all sizes of trash receptacles The device comprises a clip member having an upwardly protruding flange and a downwardly protruding flange located on opposite sides of the clip member. The clip member is secured over the rim of a trash receptacle with plastic bag handles hooked onto the upwardly protruding flange if the trash receptacle is tall, or the downwardly protruding flange if the trash receptacle is short. The plastic bag hanger device may also include a second upwardly protruding flange for storing extra plastic handled bags.

13 Claims, 1 Drawing Sheet

PLASTIC BAG HANGER DEVICE

BACKGROUND OF THE INVENTION

The present invention relates generally to a garbage bag hanger device. More particularly, the present invention relates to a clip for holding plastic garbage bags inside of trash receptacles.

Most all grocery stores presently use plastic grocery bags with handles for bagging groceries. Usually, these plastic bags are preferred by consumers over paper bags for a number of reasons including: 1) that the bags are easier to carry, 2) that it is easier to carry a larger number of bags at one time, 3) that the bags can be easily reused as trash can liners, and 4) that the bags do not require the destruction of trees or forests for their production.

Several devices currently exist for holding trash bags inside of trash receptacles. However, most of the current devices are designed to accommodate the larger sized trash containers by providing a means for hanging the handles of the plastic grocery bags inside of the trash container. Although this type of design results in the under-utilization of the entire volume of the trash container, it does provide a simple means for enabling one to use the plastic bags received from grocery stores as trash can liners. Reusing the plastic grocery bags as trash can liners is both economical and beneficial to the environment in that fewer bags need be bought and produced Other trash bag holding devices are designed to permit the trash bags to cover the upper rims of the trash receptacles. However, none of the prior art devices designed so far accommodate both large and small size trash cans.

In addition, although the dual purpose of the plastic grocery bags is desirable, individuals are less likely to use the plastic grocery bags as trash can liners if the bags are not readily accessible or if it is inconvenient to store the plastic grocery bags until they are needed.

Therefore, there is an unfilled need in the prior art for a simple and inexpensive device for hanging plastic grocery bags inside trash receptacles of any size which also includes a means for storing the plastic grocery bags so that they are readily accessible when needed.

SUMMARY OF THE INVENTION

Accordingly, it is a principal object of the present invention to provide a device for hanging a plastic bag, in particular, a plastic grocery bag with handles, inside of a trash receptacle so that the bag can be used as a liner.

It is a further object of the present invention to provide a device for hanging a plastic bag inside of a trash receptacle that accommodates all sizes of trash receptacles including those trash receptacles that are tall and short.

It is still a further object of the present invention to provide a device for hanging a plastic bag, in particular, a plastic grocery bag with handles, inside of a trash receptacle which includes a hook member for storing excess grocery bags on the outside of the trash receptacle so that they are readily accessible.

It is yet a further object of the present invention to provide a device which affords a second use for plastic grocery bags thereby aiding the environment in reducing the number of garbage bags which must be produced.

It is still a further object of the present invention to provide a device for hanging a plastic bag inside of a trash receptacle which is reversibly attachable to the sides of the trash receptacle.

In brief, there is provided a plastic bag hanger device which includes a clip-type member, having a substantially inverted "U"-shape, with first and second ends which correspond to the ends of the "U". The bag hanger device further includes an upwardly protruding flange on one side of the inverted "U"-shaped member and a downwardly protruding flange on the other side of the inverted "U"-shaped member. When the plastic bag hanger device is clipped over the rim of a trash receptacle, the upwardly protruding flange is located on the inside of the trash receptacle while the downwardly protruding flange is located on the outside of the trash receptacle. When the plastic bag hanger device is in place, each of the first and second ends of the clip-type member are in contact with a side wall of the trash receptacle. Two plastic bag hanger devices are used in order to hang the handles on the plastic bags opposite one another, thereby supporting the plastic bag inside of the trash receptacle.

In another embodiment of the present invention, that side of the clip-type member that rests against the outside wall of the trash receptacle and, therefore, that side which contains the downwardly protruding flange, comprises a second upwardly protruding flange near the end of the clip shaped member. This second upwardly protruding flange is used for storing extra plastic garbage bags thereby making them readily accessible when a bag becomes full and needs to be changed.

The objects and advantages of this invention will appear more fully from the following more detailed description of the preferred embodiments of the invention made in conjunction with the accompanying drawings.

DETAILED DESCRIPTION OF THE PREFERRED EMBODIMENTS

Figure 1:
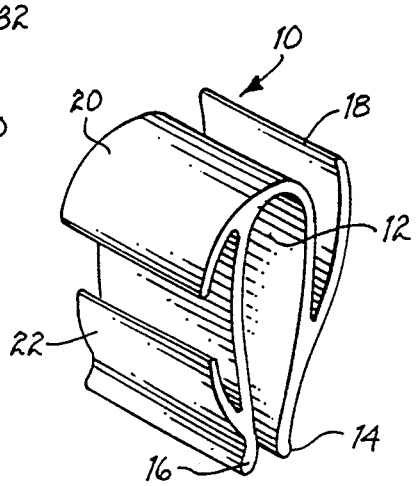
FIG. 1 is a perspective view of a first preferred embodiment of the plastic bag hanger device in accordance with the present invention.

In accordance with a first preferred embodiment of the present invention, FIG. 1 illustrates a perspective view of the plastic bag hanger device 10. The plastic bag hanger device 10 comprises a substantially inverted "U"-shaped member 12 having a first end 14 and a second end 16. The plastic bag hanger device 10 further comprises a first upwardly protruding flange 18 which is located on that side of the substantially inverted "U"-shaped member 12 which comprises the first end 14 of the substantially inverted "U"-shaped member 12, and a downwardly protruding flange 20 which is located on that side of the substantially inverted "U"-shaped member 12 which comprises the second end 16 of the substantially inverted "U"-shaped member 12. That side of the substantially inverted "U"-shaped member 12 which terminates in the second end 16 of the substantially "U"-shaped member 12 further comprises a second upwardly extending flange member 22 whereby extra plastic bags can be stored on the outside of a trash receptacle. The utilization of the second end upwardly extending flange member 22 of the substantially inverted "U"-shaped member 12 is better illustrated in FIG. 2.

The plastic bag hanger device 10 is preferably composed of a thermo plastic such as acrylonitrile butadiene styrene or high impact styrene, which can be easily adapted to fit securely over a rim of a trash receptacle. In addition, the plastic bag hanger device 10 is preferably formed from a one-piece mold in order to facilitate production and contain production costs, as well as to enhance the strength of the device.

Figure 2:
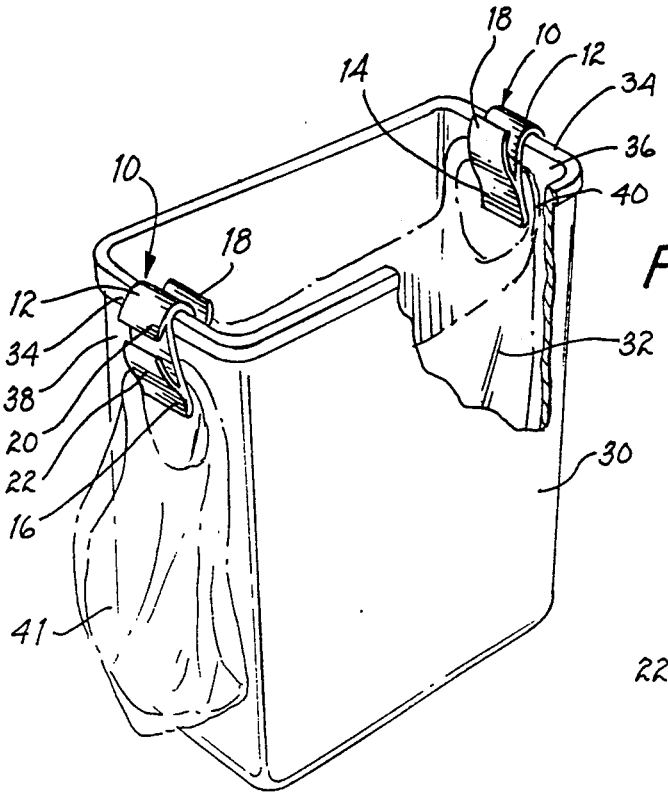
FIG. 2 is a perspective view of a trash receptacle shown cut away having the first preferred embodiment of two of the garbage bag hanger devices according to the present invention mounted thereon supporting a plastic bag on the inside of the trash receptacle and storing a plastic bag with handles, containing additional plastic bags, on the outside of the trash receptacle.

FIG. 2 shows a perspective view of two plastic bag hanger devices 10 which are mounted to a trash receptacle 30 shown cut away to illustrate a plastic bag 32 hanging inside of the trash receptacle 30. The plastic bag hanger devices 10 are clipped onto opposite rims 34 of the trash receptacle 30 so that the first and second ends 14, 16 of each substantially inverted "U"-shaped member 12 are seated against the inside wall 36 and outside wall 38 of the trash receptacle 30, respectively.

Furthermore, in FIG. 2, the plastic bag 32 has handles 40 which are hung on the first upwardly protruding flanges 18 of the plastic bag hanger devices 10. The first upwardly protruding flanges 18 located on the inside of the trash receptacle 30 are utilized with taller trash receptacles so that the plastic bag 32 can be suspended down into the interior of the trash receptacle 30, thereby enabling the entire volume of the plastic bag 32 to be filled. On the other hand, the downwardly protruding flange members 20 are utilized with the shorter trash receptacles so that a plastic bag will be able to line the entire interior of the shorter trash receptacle as well as cover the rim of the shorter trash receptacle. The anchoring of the plastic bag 32 onto the plastic bag hanger device 10, with respect to a shorter trash receptacle, is better illustrated in FIG. 3.

Finally, FIG. 2 shows the utilization of the second upwardly protruding flange members 22 of one of the substantially inverted "U"-shaped members 12. Extra plastic bags 41 are draped over the second upwardly protruding flange member 22 in order to store the extra plastic bags 41 where they are readily accessible.

Figure 3:
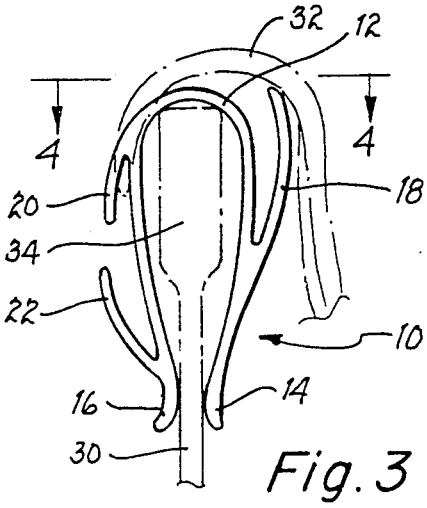
FIG. 3 is a side elevational view of the first preferred embodiment of the plastic bag hanger device in accordance with the present invention mounted to a rim of a trash receptacle shown in phantom and supporting a plastic bag shown in phantom.

With reference to FIG. 3, there is illustrated a side elevational view of the first preferred embodiment of the plastic bag hanger device 10 shown mounted to the rim 34 of a short trash receptacle 30 in phantom. In addition, a plastic bag 32 in phantom, is shown secured to the plastic bag hanger device 10 When utilizing the plastic bag hanger device 10 with a short receptacle 30, a plastic bag 32 is placed over the top of the first upwardly protruding flange 18 of the plastic bag hanger device 10 and secured under the downwardly protruding flange 20 of the plastic bag hanger device 10. As previously indicated, this enables the entire interior of the short trash receptacle 30 to be lined with the plastic bag 32. In addition, it also allows for the rim 34 of the short trash receptacle 30 to be completely covered.

The preferred embodiment of the plastic bag hanger device 10 illustrated in FIGS. 1-3 is also reversible in that the substantially inverted "U"-shaped member 12 may be clipped to a trash receptacle such that the downwardly protruding flange 20 and the second upwardly protruding flange 22 are located on the inside of the trash receptacle and the first upwardly protruding flange 18 is located on the outside of the trash receptacle. This placement of the plastic bag hanger device 10 further accommodates yet another size of trash receptacle by allowing a plastic trash bag to be hung at yet a lower level then the first upwardly protruding flange 18. In addition, this reverse placement of the plastic bag hanger device 10 still enables the storage of extra plastic bags on the outside of the trash receptacle by employing the first upwardly protruding flange 18 when hanging the additional plastic bags.

Figure 4:
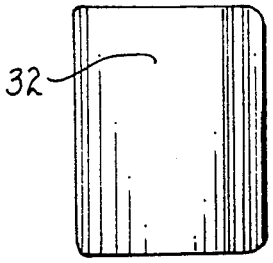
FIG. 4 is a cross-sectional view taken along line 4—4 of FIG. 3.

FIG. 4 shows a cross-section taken along line 4—4 of FIG. 3. Since securing the plastic bag 32 under the downwardly protruding flange 20 of the plastic bag hanger device 10 completely covers the rim 34 of the short trash receptacle 30, the only item seen in the cross-section is the plastic bag 32.

Figure 5:
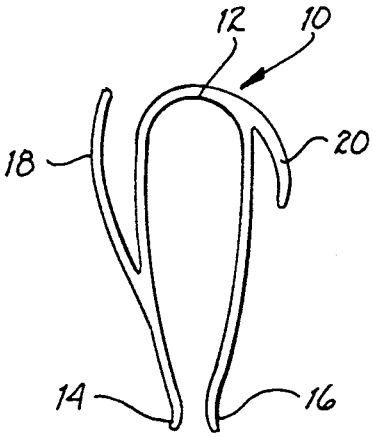
FIG. 5 is a side elevational view of a second preferred embodiment of the plastic bag hanger device in accordance with the present invention.

A second embodiment of the plastic bag hanger 10 in accordance with the present invention is illustrated in FIG. 5. FIG. 5 represents a side elevational view of the second preferred embodiment of the invention. Like the first preferred embodiment illustrated in FIG. 1, the second preferred embodiment of the plastic bag hanger device 10 comprises a substantially inverted "U"-shaped member 12 having a first end 14 and a second end 16. The plastic bag hanger device 10 further comprises an upwardly protruding flange 18 located on the side of the substantially inverted "U"-shaped member 12 which comprises the first end 14 of the substantially inverted "U"-shaped member 12, and a downwardly protruding flange 20 located on the side of the substantially inverted "U"-shaped member 12 which comprises the second end 16 of the substantially inverted "U"-shaped member 12. Like the previously described first embodiment, the second embodiment of the present invention also accommodates both tall and short sized trash receptacles.

While preferred embodiments of the invention have been shown and described, it will be apparent to those skilled in the art that various modifications may be made in these embodiments without departing from the true spirit and scope of the present invention. For that reason, the scope of the invention is set forth in the following claims.

I claim:

1. A garbage bag hanger device for hanging plastic bags inside of a trash receptacle comprising:

a substantially inverted U-shaped clip member having first and second sides thereof and a middle portion defined by a topmost section of the substantially inverted U-shaped clip located between said first and second sides;

a first flange member projecting upwardly from said first side of said substantially inverted U-shaped member; and a second flange member projecting downwardly from said middle portion nearest said second side of said substantially inverted U-shaped member.

2. The device as set forth in claim 2 wherein said substantially inverted U-shaped member is flexible.

3. The device as set forth in claim 2 wherein said substantially inverted U-shaped member clips over a top rim of said trash receptacle such that the middle portion of said substantially inverted U-shaped member rests adjacent to said rim and a portion of said first and second sides of said substantially inverted U-shaped member rest against an inside wall and an outside wall of said trash receptacle, respectively.

4. The device as set forth in claim 3 wherein said device further comprises one molded piece.

5. The device as set forth in claim 1 further comprising a third flange member projecting upwardly from said second side of said substantially U-shaped member.

6. The device as set forth in claim 5 wherein said substantially inverted U-shaped member is flexible.

7. The device as set forth in claim 6 wherein said substantially U-shaped member clips over a top rim of said trash receptacle such that the middle portion of said substantially inverted U-shaped member rests adjacent to said rim and a portion of said first and second sides of said substantially inverted U-shaped member rest against an inside wall and an outside wall of said trash receptacle, respectively.

8. The device as set forth in claim 7 wherein said device further comprises one molded piece.

9. A garbage bag hanger device for hanging plastic bags inside of a trash receptacle comprising:

a flexible substantially inverted U-shaped member having first and second sides which terminate in first and second ends, wherein said flexible substantially inverted U-shaped member clips over a top rim of said trash receptacle such that a middle portion of said flexible substantially inverted U-shaped member rests adjacent to said rim and a portion of each of said first and second sides of said flexible substantially inverted U-shaped member make contact with a side wall of said trash receptacle;

a hook-like member projecting upwardly from said first side of said substantially inverted U-shaped member; and a hook-like member projecting downwardly from said middle portion nearest said second side of said substantially inverted U-shaped member.

10. The device as set forth in claim 9 wherein said first end of said flexible substantially inverted U-shaped member rests against an inside wall of said trash receptacle and said second end of said flexible substantially U-shaped member rests against an outside wall of said trash receptacle.

11. The device as set forth in claim 10 further comprising a second hook-like member projecting upwardly from said second side of said substantially U-shaped member and located between said hook-like member projecting downwardly and said second end of said substantially U-shaped member so that excess plastic bags can be stored thereon.

12. The device as set forth in claim 11 wherein said device is one molded piece.

13. A method for hanging a plastic bag with two handles on the inside of a trash receptacle and storing similar excess plastic bags comprising the steps of:

attaching two clip members each having first and second upwardly protruding flanges and a downwardly protruding flange on opposite sides of the trash receptacle;

attaching one of the two handles of said plastic bag to at at least one of the upwardly protruding flange and the downwardly protruding flange on one of said two clip members;

attaching the other of the two handles of said plastic bag to at least one of the first upwardly protruding flange and the downwardly protruding flange on the other of said two clip members; and hooking the excess plastic bags on the second upwardly protruding flange of at least one of the two clip members.

* * * * *